US011434728B2

(12) United States Patent
Presslie et al.

(10) Patent No.: US 11,434,728 B2
(45) Date of Patent: Sep. 6, 2022

(54) COMPLETION SYSTEM APPARATUS

(71) Applicant: Weatherford U.K. Limited, Leicestershire (GB)

(72) Inventors: Mark Presslie, Aberdeen (GB); Andrew Franklin, Aberdeen (GB); Paul Day, Aberdeen (GB)

(73) Assignee: Weatherford U.K. Limited, Leicestershire (GB)

( * ) Notice: Subject to any disclaimer, the term of this patent is extended or adjusted under 35 U.S.C. 154(b) by 64 days.

(21) Appl. No.: 16/963,910

(22) PCT Filed: Feb. 8, 2019

(86) PCT No.: PCT/GB2019/050345
§ 371 (c)(1),
(2) Date: Jul. 22, 2020

(87) PCT Pub. No.: WO2019/155227
PCT Pub. Date: Aug. 15, 2019

(65) Prior Publication Data

US 2020/0386083 A1 Dec. 10, 2020

(30) Foreign Application Priority Data

Feb. 9, 2018 (GB) ..... 1802189

(51) Int. Cl.
*E21B 43/04* (2006.01)
*E21B 43/08* (2006.01)
*E21B 34/14* (2006.01)

(52) U.S. Cl.
CPC ..... *E21B 43/045* (2013.01); *E21B 43/04* (2013.01); *E21B 43/08* (2013.01); *E21B 34/14* (2013.01);
(Continued)

(58) Field of Classification Search
CPC ..... E21B 43/045; E21B 43/08; E21B 34/14; E21B 2200/04; E21B 2200/05;
(Continued)

(56) References Cited

U.S. PATENT DOCUMENTS 4,583,593 A 4/1986 Zunkel et al.
6,782,948 B2 8/2004 Echols et al.
(Continued)

FOREIGN PATENT DOCUMENTS

WO 2011028563 A2 3/2011

OTHER PUBLICATIONS

UK Search Report received in copending UK Application No. GB1802189.9 dated Jun. 25, 2018, 8 pages.
(Continued)

*Primary Examiner* — Michael R Wills, III
(74) *Attorney, Agent, or Firm* — Blank Rome LLP

(57) ABSTRACT

A completion system apparatus having a body comprising a throughbore and lateral flow ports for providing access through a wall of the body and a valve arrangement including a first, uphole, valve assembly and a second, downhole, valve assembly. The valve arrangement is configurable between a first, open, configuration in which passage of fluid through the axial throughbore is permitted and a second, activated, configuration, the valve arrangement in the second, activated, configuration preventing passage of fluid in the first, downhole, direction so as to direct the fluid through the lateral flow ports while permitting the passage of fluid through the apparatus in a second, uphole, direction so as to permit return passage of the fluid through the apparatus. A bypass arrangement is configured to permit fluid travelling in the second direction to bypass the first valve assembly.

16 Claims, 5 Drawing Sheets

(52) U.S. Cl.
CPC ..... *E21B 2200/04* (2020.05); *E21B 2200/05* (2020.05); *E21B 2200/06* (2020.05)

(58) Field of Classification Search
CPC .... E21B 2200/06; E21B 43/04; E21B 33/124; E21B 34/06; E21B 34/08
See application file for complete search history.

(56) References Cited

U.S. PATENT DOCUMENTS

| | | | | |
|---|---|---|---|---|
| 7,543,641 | B2 | 6/2009 | Contant | |
| 7,950,454 | B2 | 5/2011 | Patel et al. | |
| 8,056,628 | B2 | 11/2011 | Whitsitt et al. | |
| 8,245,782 | B2 * | 8/2012 | Sanchez | E21B 43/14 166/278 |
| 8,857,518 | B1 | 10/2014 | Tips et al. | |
| 2009/0025923 | A1 * | 1/2009 | Patel | E21B 43/045 166/51 |
| 2010/0163235 | A1 | 7/2010 | Mootoo et al. | |
| 2011/0284232 | A1 | 11/2011 | Huang | |
| 2013/0008652 | A1 | 1/2013 | Broussard et al. | |
| 2014/0041876 | A1 | 2/2014 | Fleckenstein et al. | |
| 2014/0166111 | A1 | 6/2014 | Wilkin | |

OTHER PUBLICATIONS

Int'l Search Report received in copending PCT Application No. PCT/GB2019/050345 dated Apr. 15, 2019, 10 pages.

* cited by examiner

COMPLETION SYSTEM APPARATUS

FIELD

This relates to a completion system apparatus.

BACKGROUND

In the oil and gas exploration and production industry, in order to access a subsurface hydrocarbon-bearing formation a well borehole is drilled from surface, the borehole typically then being lined with sections of metal tubing known as casing. A tubing string, known as a completion string, is then run into the borehole, the completion string including amongst other things production tubing used to transport the hydrocarbons extracted from the formation towards surface as well as tools and equipment to perform a variety of downhole operations.

One such downhole operation—which aims to prevent particulate material such as sand and other solids from entering the production tubing—is known as a gravel pack operation. In a typical gravel pack operation, a gravel slurry containing a proppant and a carrier fluid is pumped downhole, the proppant used to pack the annulus between the completion string and the borehole while the carrier fluid is returned to surface. Once in place, the proppant permits production fluid to enter the completion string but prevents the ingress of particulate material such as sand and other solids.

Controlling ingress of particulate material is often critical to maintaining operational and production efficiency of a given well, and while gravel packing provides an effective means to control ingress of particulate material there are limitations to conventional techniques, tools and equipment.

For example, a typical gravel pack operation requires a number of trips into the borehole, increasing operational time and cost to the operator.

SUMMARY

According to a first aspect, there is provided a completion system apparatus, comprising: a body configured for location in a borehole, the body comprising an axial flow passage therethrough and a lateral flow passage for providing access through a wall of the body; and a valve arrangement, wherein the valve arrangement is configurable between a first, open, configuration in which passage of fluid through the axial flow passage is permitted and a second, activated, configuration, the valve arrangement in the second, activated, configuration preventing passage of fluid in a first direction so as to direct the fluid through the lateral flow passage while permitting the passage of fluid through the apparatus in a second direction so as to permit return passage of the fluid through the apparatus.

The apparatus may form part of a completion system configured for location in the borehole, the apparatus suitable for use in a borehole operation, for example but not exclusively a borehole packing operation, a fluid pumping operation, a frack packing operation, a stimulation operation, a placement operation or the like.

Beneficially, embodiments of the apparatus obviate the need for a crossover tool and/or wash pipe string which e.g. in conventional gravel pack operations are required to provide separate inflow and return flow paths for the gravel slurry and returning carrier fluid during the gravel pack operation. Since there is no requirement to run the crossover tool and/or wash pipe string into the completion string, the operation can be carried out in a single trip. Moreover, while conventional systems and techniques require the completion to be run with a separate lower completion (located across the production or injection zone) and upper completion (to surface) in order to facilitate operations, embodiments of the apparatus additionally permit the operator to run the whole completion system in a single trip, improving reliability and/or significantly reducing operational complexity, time and cost for the operator.

As described above, the valve arrangement is configurable in a first, open, configuration in which passage of fluid through the axial flow passage is permitted, the apparatus reconfigurable from the first configuration to the second, activated, configuration.

The first, open, configuration may define a run-in configuration of the apparatus and, in use, the apparatus may be run into the borehole in the first configuration such that fluid may be circulated through the apparatus while the completion system is run into the borehole.

As described above, the valve arrangement in the second configuration prevents passage of fluid in a first direction, e.g. a downhole direction, so as to direct the fluid through the lateral flow passage.

In use, the apparatus may be run into the borehole with the valve arrangement in the first configuration, the valve arrangement being reconfigured to the second, activated, configuration, on reaching the desired downhole location.

The valve arrangement may comprise a first valve assembly.

The first valve assembly may comprise a valve member, such as a ball.

The valve member may comprise a throughbore.

In the first configuration, the valve member may be arranged such that the throughbore of the valve member is aligned or substantially aligned with the axial flow passage of the body, thereby permitting passage of fluid through the apparatus.

In the second configuration, the valve member may be arranged such that the throughbore of the valve member and the axial flow passage of the body are misaligned, thereby closing the first valve assembly to passage of the fluid in the first direction, e.g. downhole direction.

The first valve assembly may comprise a valve actuator arrangement.

The valve actuator arrangement may be operable to move the valve member, e.g. ball, to reconfigure the valve arrangement from the first configuration to the second configuration.

The valve actuator arrangement may be operable to rotate the valve member, e.g. ball, to reconfigure the valve arrangement from the first configuration to the second configuration.

For example, the valve actuator arrangement may be operable to rotate the valve member through 90 degrees. However, it will be recognised that the valve actuator arrangement may be operable to rotate the valve member through any suitable angle to prevent or substantially prevent passage of fluid through the valve member.

The valve actuator arrangement may comprise a sleeve.

The sleeve may be configured to move relative to the body.

The sleeve may be configured to move axially relative to the body.

The sleeve may be coupled to the valve member.

The sleeve may be coupled to the valve member such that axial movement of the sleeve may rotate the valve member to reconfigure the valve arrangement from the first, open, configuration to the second, activated, configuration.

The valve actuator arrangement may comprise a biasing member, e.g. a spring, configured to act on the sleeve.

The biasing member may act on the sleeve to normally maintain the valve member in the second configuration.

The valve actuator arrangement may be fluid actuable.

The valve actuator arrangement may comprise a piston.

The piston may be coupled to, form part of or operatively associated with the sleeve.

In use, the piston may be actuated to move the sleeve axially relative to the body, said axial movement moving the valve member and thereby reconfiguring the valve arrangement from the first configuration to the second configuration.

In particular embodiments, the valve actuator arrangement is hydraulically actuable.

Alternatively or additionally, the valve actuator arrangement may be pneumatically actuated, electrically actuated, and/or mechanically actuated.

The apparatus may be configured to cover the lateral flow passage with the sleeve of the first valve assembly.

The sleeve of the first valve assembly may be configured to move relative to the body to a position which obturates the lateral flow passage.

In use, following completion of the borehole operation, e.g. borehole packing operation, the sleeve may be moved relative to the body to obturate the lateral flow passage.

The valve arrangement may comprise a second valve assembly.

The second valve assembly may comprise a valve member, such as a ball.

The valve member may comprise a throughbore.

In the first configuration, the valve member may be arranged such that the throughbore of the valve member is aligned or substantially aligned with the axial flow passage of the body, thereby permitting passage of fluid through the apparatus.

In the second configuration, the valve member may be arranged such that the throughbore of the valve member and the axial flow passage are misaligned, thereby closing the second valve assembly to passage of the fluid in the first direction, e.g. downhole direction.

The second valve assembly may comprise a valve actuator arrangement.

The valve actuator arrangement may be operable to move the valve member, e.g. ball, to reconfigure the valve arrangement from the first configuration to the second configuration.

The valve actuator arrangement may be operable to rotate the valve member, e.g. ball, to reconfigure the valve arrangement from the first configuration to the second configuration.

For example, the valve actuator arrangement may be operable to rotate the valve member through 90 degrees. However, it will be recognised that the valve actuator arrangement may be operable to rotate the valve member through any suitable angle to prevent or substantially prevent passage of fluid through the valve member.

The valve actuator arrangement may comprise a sleeve.

The sleeve may be configured to move relative to the body.

The sleeve may be configured to move axially relative to the body.

The sleeve may be coupled to the valve member.

The sleeve may be coupled to the valve member such that axial movement of the sleeve may rotate the valve member to reconfigure the valve arrangement from the first, open, configuration to the second, activated, configuration.

The valve actuator arrangement may be fluid actuable.

The valve actuator arrangement may comprise a piston.

The piston may be coupled to, form part of or operatively associated with the sleeve.

In use, the piston may be actuated to move the sleeve axially relative to the body, said axial movement moving the valve member and thereby reconfiguring the valve arrangement from the first configuration to the second configuration.

In particular embodiments, the valve actuator arrangement is hydraulically actuable.

Alternatively or additionally, the valve actuator arrangement may be pneumatically actuated, electrically actuated, and/or mechanically actuated.

The first valve assembly may comprise a second valve member.

The second valve member may be coupled to and/or form part of the valve member of the second valve assembly.

The second valve member may comprise or take the form of a flapper.

The second valve assembly may be configured so that the second valve member, e.g. flapper, defines a normally closed position.

The first valve assembly may comprise a biasing member, e.g. a spring, configured to maintain the second valve member, e.g. flapper, in a closed position.

As described above, the valve arrangement in the second configuration also permits passage of fluid in a second direction, e.g. uphole direction, so as to direct fluid returns through the apparatus.

The second valve assembly may comprise a second valve member.

The second valve member may be coupled to and/or form part of the valve member of the second valve assembly.

The second valve member may comprise or take the form of a flapper.

The second valve assembly may be configured so that the second valve member, e.g. flapper, defines a normally closed position.

The second valve assembly may comprise a biasing member, e.g. a spring, configured to maintain the second valve member, e.g. flapper, in a closed position.

In use, the first valve assembly may define an upper diverter valve of the apparatus and the second valve assembly may define a lower diverter valve of the apparatus.

The first valve assembly and the second valve assembly may define a chamber therebetween.

The completion system apparatus may comprise a bypass arrangement.

The bypass arrangement may comprise a bypass conduit.

The bypass conduit may be formed in the body. For example, the body may comprise one or more bore forming the bypass conduit.

Alternatively, the bypass conduit may comprise tubing.

The bypass conduit may communicate with the chamber defined between the first valve assembly and the second valve assembly.

In use, the bypass conduit may permit fluid ravelling in the second direction, e.g. uphole direction, to bypass the first valve assembly.

Beneficially, when the valve arrangement defines the second configuration the apparatus permits fluid travelling in the first, downhole, direction to be diverted through the lateral flow passage into the annulus between the apparatus and the borehole while simultaneously permitting fluid travelling in the second, uphole, direction to bypass the first valve assembly and return to surface.

Embodiments of the apparatus thus obviate the need for a crossover tool and/or wash pipe string which, e.g. in conventional gravel pack operations, are required to provide separate inflow and return flow paths for the gravel slurry and returning carrier fluid during the gravel pack operation, this permitting the gravel pack operation to be carried out in a single trip, improving reliability and/or significantly reducing operational complexity, time and cost for the operator.

The bypass arrangement may comprise a bypass valve.

The bypass valve may communicate with the bypass conduit.

The bypass valve may comprise a lateral flow passage.

The lateral flow passage of the bypass valve may comprise or take the form of one or more flow port.

The bypass valve may comprise a sleeve.

The bypass valve may be configurable between a first, closed, configuration, in which lateral passage of fluid is prevented or restricted and a second, open, configuration, in which lateral passage of fluid is permitted.

In use, fluid returns may be directed through the bypass conduit and pass through the lateral flow passage of the bypass valve into the annulus between the apparatus and the borehole.

The apparatus may comprise, may be provided in combination with, and/or may be coupled to, a packer arrangement.

The packer arrangement may comprise a first packer.

The first packer may be fluid actuated.

The first packer may be hydraulically actuated.

Alternatively or additionally, the first packer may be pneumatically actuated, electrically actuated, and/or mechanically actuated.

The first packer may comprise a bypass conduit.

The bypass conduit of the first packer may communicate with the bypass conduit and the bypass valve.

The packer arrangement may comprise a second packer.

The second packer may be fluid actuated.

The second packer may be hydraulically actuated.

Alternatively or additionally, the second packer may be pneumatically actuated, electrically actuated, and/or mechanically actuated.

The second packer may comprise a bypass conduit.

The bypass conduit of the second packer may comprise or take the form of a shunt tube.

The first packer may define an uphole packer of the apparatus and the second packer may define a downhole packer of the apparatus. The first packer may be disposed at an uphole location relative to the lateral flow passage.

In use, the first packer prevents fluid exiting the lateral flow passage from passing in an uphole direction beyond the first packer, and prevents intermixing with the fluid exiting the bypass valve.

As described above, the apparatus comprises a body comprising an axial flow passage and a lateral flow passage.

The axial flow passage may comprise an axial throughbore.

The throughbore may be configured to permit fluid, e.g. downhole tooling and equipment through the apparatus—and in due course oil and/or gas production fluid flows to surface.

The lateral flow passage may comprise one or more flow port.

The apparatus may comprise, may be coupled to, or may be operatively associated with a power supply.

The power supply may comprise a hydraulic power supply, such as a Hydraulic Power Unit (HPU). In particular embodiments, the power supply comprises an Electric Hydraulic Power Unit (EHPU).

The power supply, e.g. HPU or EHPU, may be configured to activate the valve arrangement to reconfigure the valve arrangement from the first configuration to the second configuration.

The power supply, e.g. HPU or EHPU, may be configured to activate the packer arrangement.

The power supply, e.g. HPU or EHPU, may be configured to activate the bypass valve.

The apparatus may be provided in combination with, form part of, and/or may be coupled to, a completion system.

According to a second aspect, there is provided a completion system comprising the apparatus of the first aspect.

The completion system may comprise a screen, such as a sand screen, and in particular embodiments the completion system may comprise a plurality of the screens.

According to another aspect, there is provided a method comprising: activating a valve arrangement of an apparatus according to the first aspect from a first, open, configuration in which passage of fluid through an axial flow passage of a body of the apparatus is permitted to a second, activated, configuration, the valve arrangement in the second, activated, configuration preventing passage of fluid in a first direction so as to direct the fluid through a lateral flow passage of the body of the apparatus while permitting the passage of fluid through the apparatus in a second direction so as to permit return passage of the fluid through the apparatus.

The method may comprise running a completion system comprising the apparatus of the first aspect into a borehole.

The method may comprise directing a fluid through the apparatus.

The fluid may comprise a borehole packing material, such as gravel slurry or the like.

Other aspects relate to use of the apparatus of the first aspect or the completion system of the second aspect in a borehole operation, in particular but not exclusively a borehole packing operation such as a gravel pack operation, a fluid pumping operation, a frack packing operation, a stimulation operation, a placement operation or the like.

It will be understood that features defined above or below may be utilised in isolation or in combination with any other defined feature.

DETAILED DESCRIPTION

Figure 1:
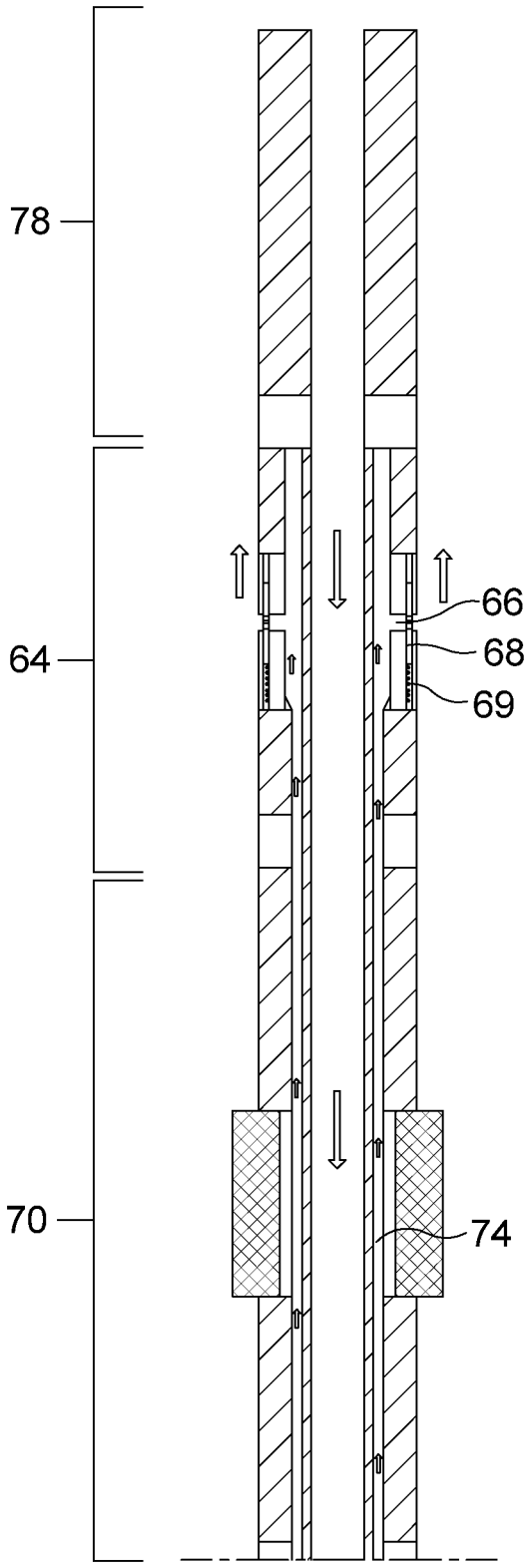
FIG. 1 shows a longitudinal section view of a first, upper, portion of a completion system apparatus.
Figure 2:
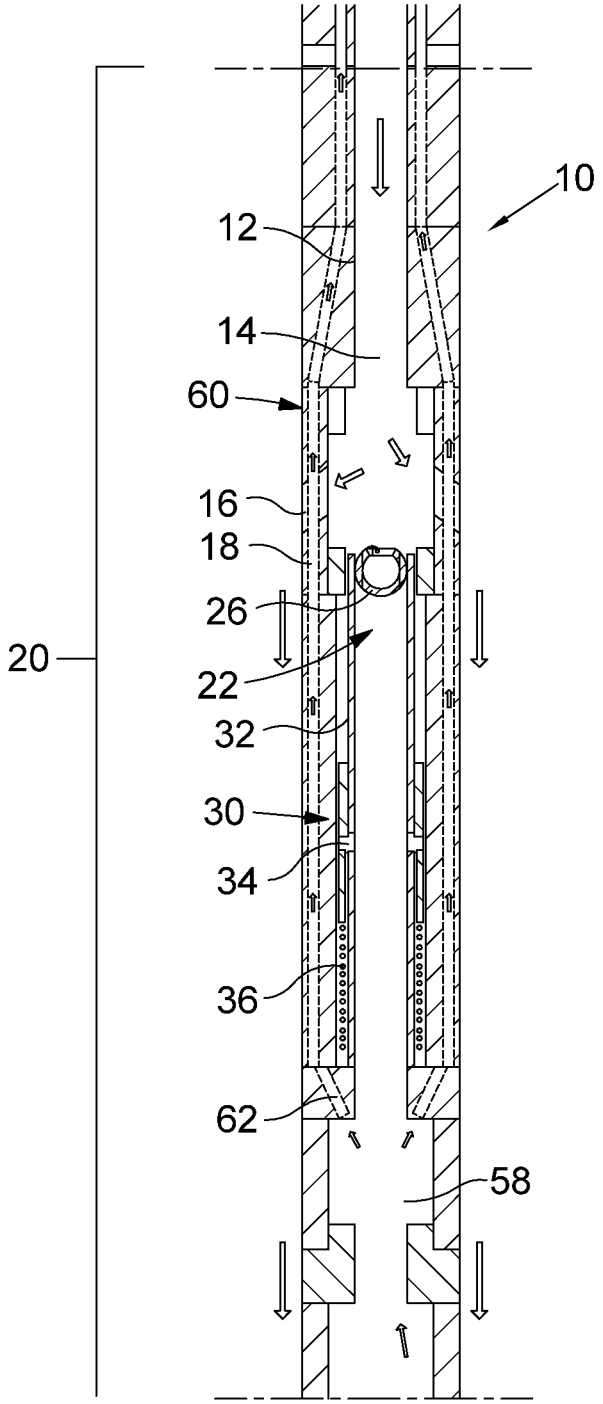
FIG. 2 shows a longitudinal section view of a second, middle, portion of the completion system apparatus shown in FIG. 1.
Figure 3:
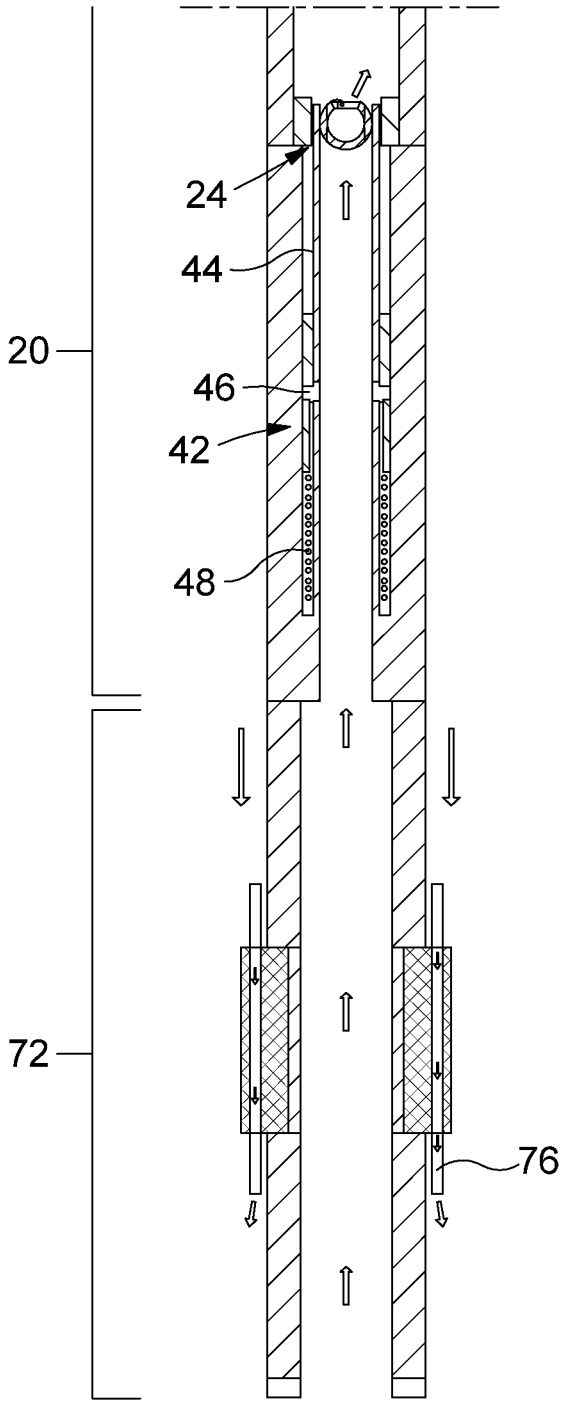
FIG. 3 shows a longitudinal section view of a third, lower, portion of the completion system apparatus shown in FIG. 1.

FIGS. 1 to 3 of the accompanying drawings together show a completion system apparatus 10 for location in a borehole B, FIG. 1 showing a first, upper, portion of the completion system apparatus 10, FIG. 2 showing a second, middle, portion of the completion system apparatus 10 and FIG. 3 showing a third, lower, portion of the completion system apparatus 10.

As shown, the apparatus 10 has a body 12 comprising an axial flow passage in the form of axial throughbore 14 and a lateral flow passage in the form of lateral flow ports 16 (two flow ports are shown in the FIG. 2) for providing access through a wall 18 of the body 12.

The apparatus comprises a valve arrangement 20, the valve arrangement 20 including a first, uphole, valve assembly 22 (shown in FIG. 2) and a second, downhole, valve assembly 24 (shown in FIG. 3).

The valve arrangement 20 is configurable between a first, open, configuration in which passage of fluid through the axial throughbore 14 is permitted and a second, activated, configuration, the valve arrangement 20 in the second, activated, configuration preventing passage of fluid in a first, downhole, direction so as to direct the fluid through the lateral flow ports 16 while permitting the passage of fluid through the apparatus 10 in a second, uphole, direction so as to permit return passage of the fluid through the apparatus 10.

In use, the apparatus 10 is run into the borehole B in the first configuration such that fluid may be circulated through the apparatus 10, the valve arrangement 20 being reconfigured to the second, activated, configuration, on reaching the desired downhole location (as shown in FIGS. 1 to 3, and FIGS. 5 to 8 of the accompanying drawings).

Beneficially, embodiments of the apparatus 10 obviate the need for a crossover tool and/or wash pipe string which in conventional gravel pack operations are required to provide separate inflow and return flow paths for the gravel slurry and returning carrier fluid during the gravel pack operation. Since there is no requirement to run the crossover tool and/or wash pipe string into the completion string, the gravel pack operation can be carried out in a single trip. Moreover, while conventional systems and techniques require the completion to be run with a separate lower completion (located across the production or injection zone) and upper completion (to surface) in order to facilitate gravel packing operations, embodiments of the apparatus additionally permit the operator to run the whole completion system in a single trip, improving reliability and/or significantly reducing operational complexity, time and cost for the operator.

As shown in FIG. 2, the first valve assembly 22 comprises a valve member 26 having a throughbore 28. In the illustrated apparatus 10, the valve member 26 takes the form of a ball.

In the first configuration, the valve member 26 is arranged such that the throughbore 28 is aligned or substantially aligned with the axial throughbore 14 of the body 12, thereby permitting passage of fluid through the apparatus 10.

In the second configuration, the valve member 26 is arranged such that the throughbore 28 and the axial throughbore 14 of the body 12 are misaligned, thereby closing the first valve assembly 22 to passage of the fluid in the first, downhole, direction.

The first valve assembly 22 further comprises a valve actuator arrangement 30 including a sleeve 32 and a piston 34, the valve actuator arrangement 30 operable so that axial movement of the sleeve 32 rotates the valve member 26.

A biasing member in the form of spring 36 is provided, the spring 36 configured to act on the sleeve 32 to normally maintain the valve member 26 in the second configuration.

In the illustrated apparatus 10, the valve actuator arrangement 30 is hydraulically actuable, the piston 34 coupled to the sleeve 32 such that movement of the piston 34 moves the sleeve 32 axially relative to the body 12.

As can be seen from FIG. 2, the sleeve 32 is configurable to move relative to the body 12 to a position which obturates the lateral flow ports 16. In use, following completion of the borehole operation, e.g. borehole packing operation, the sleeve 32 may be moved relative to the body 12 to obturate the lateral flow ports 16.

As shown in FIG. 3, the second valve assembly 24 also comprises a valve member 38 having a throughbore 40. In the illustrated apparatus 10, the valve member 38 takes the form of a ball.

In the first configuration, the valve member 38 is arranged such that the throughbore 40 is aligned or substantially aligned with the axial throughbore 14 of the body 12, thereby permitting passage of fluid through the apparatus 10.

In the second configuration, the valve member 38 is arranged such that the throughbore 40 and the axial throughbore 14 of the body 12 are misaligned, thereby closing the second valve assembly 24 to passage of the fluid in the first, downhole, direction.

The second valve assembly 24 further comprises a valve actuator arrangement 42 including a sleeve 44 and a piston 46, the valve actuator arrangement 42 operable so that axial movement of the sleeve 44 rotates the valve member 38.

A biasing member in the form of spring 48 is provided, the spring 48 configured to act on the sleeve 44 to normally maintain the valve member 38 in the second configuration.

In the illustrated apparatus 10, the valve actuator arrangement 42 is hydraulically actuable, the piston 46 coupled to the sleeve 32 such that movement of the piston 46 moves the sleeve 32 axially relative to the body 12.

As shown in FIGS. 2 and 3, and referring now also to FIGS. 4 to 7 of the accompanying drawings, both the first valve assembly 22 and the second valve assembly 24 have second valve members in the form of a flappers 50, 52.

Figure 4:
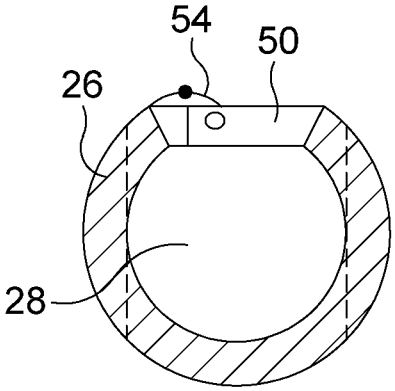
FIG. 4 shows an enlarged view of the valve member of the first valve assembly of the completion system apparatus shown in FIGS. 1 to 3.
Figure 5:
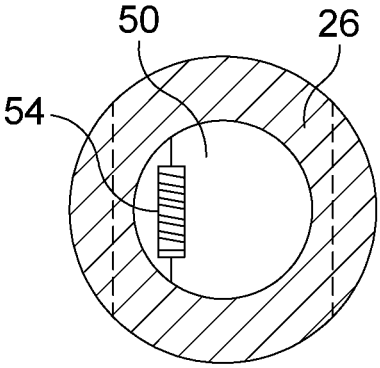
FIG. 5 shows an enlarged plan view of the valve member of the first valve assembly completion system apparatus shown in FIGS. 1 to 3.

Flapper 50 is coupled to the valve member 26 via sprung hinge 54 (as shown in FIGS. 4 and 5).

Figure 6:
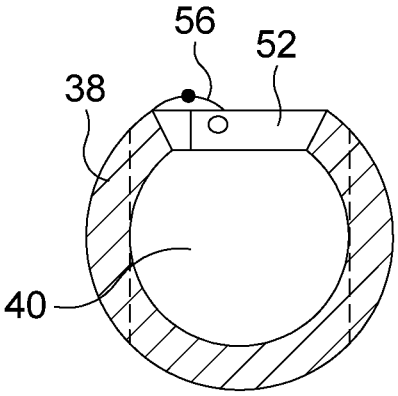
FIG. 6 shows an enlarged view of the valve member of the second valve assembly of the completion system apparatus shown in FIGS. 1 to 3.
Figure 7:
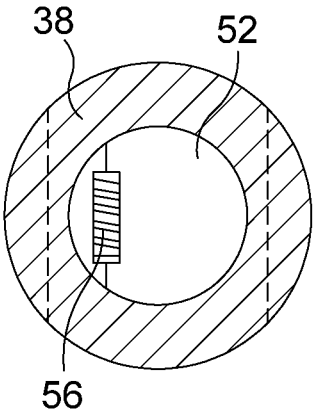
FIG. 7 shows an enlarged plan view of the valve member of the second valve assembly completion system apparatus shown in FIGS. 1 to 3.

Flapper 52 is coupled to the valve member 38 via sprung hinge 56 (as shown in FIGS. 6 and 7).

In use, the first valve assembly 22 defines an upper diverter valve of the apparatus 10 and the second valve assembly 24 defines a lower diverter valve of the apparatus 10, the first valve assembly 22 and the second valve assembly 24 defining a chamber 58 therebetween.

As shown in FIG. 2, it can be seen that the completion system apparatus 10 further comprises a bypass arrangement 60, which in the illustrated apparatus 10 includes a bypass conduit in the form of drilled bores 62 which communicate with the chamber 58.

In use, the bores 62 permit fluid travelling in the second, uphole, direction to bypass the first valve assembly 22.

Beneficially, when the valve arrangement defines the second configuration the apparatus 10 permits fluid travelling in the first, downhole, direction to be diverted through the lateral flow ports 16 into the annulus between the apparatus 10 and the borehole while simultaneously permitting fluid travelling in the second, uphole, direction to bypass the first valve assembly 22 and return to surface.

Embodiments of the apparatus thus obviate the need for a crossover tool and/or wash pipe string which in conventional gravel pack operations are required to provide separate inflow and return flow paths for the gravel slurry and returning carrier fluid during the gravel pack operation, this permitting the gravel pack operation to be carried out in a single trip, improving reliability and/or significantly reducing operational complexity, time and cost for the operator.

As shown in FIG. 1, the bypass arrangement 60 further comprises a bypass valve in the form of return valve 64 which communicates with the bores 62.

The return valve 64 takes the form of a sliding sleeve device having a lateral flow passage 66 and a sleeve 68 biased by spring 69.

The return valve 64 is configurable between a first, closed, configuration, in which lateral passage of fluid is prevented or restricted and a second, open, configuration, in which lateral passage of fluid is permitted.

In use, fluid returns may be directed through the bores 62 and pass through the lateral flow passage 66 of the return valve 64 into the annulus between the apparatus 10 and the borehole.

As shown in FIGS. 1 and 3, the apparatus 10 comprises a packer arrangement comprising a first, uphole, packer 70 and a second, downhole, packer 72.

As shown in FIG. 1, the first packer 70 comprises a bypass conduit 74 which provides communication between the return valve 64 and the bores 62.

In use, the first packer 70 prevents fluid exiting the lateral flow ports 16 from passing in an uphole direction beyond the first packer 70, and prevents intermixing with the fluid returns exiting the return valve 64.

As shown in FIG. 3, the second, downhole, packer 72 comprises a bypass conduit in the form of shunt tubes 76.

In use, the shunt tubes 76 permit fluid to bypass the second packer 72. When utilised in a borehole packing operation, e.g. gravel pack operation, the ability to bypass the second packer 72 improves the consistency of the gravel pack by permitting the fluid and thus the gravel to be directed to the lowermost location so as pack the borehole from bottom to top.

In the illustrated apparatus, the packers 70, 72 are hydraulically actuated.

As shown in FIG. 1, the apparatus 10 comprises a power supply, which in the illustrated apparatus 10 takes the form of a Hydraulic Power Unit (HPU) 78.

In use, HPU 78 is configured to activate the valve arrangement to reconfigure the valve arrangement from the first configuration to the second configuration.

In the illustrated apparatus 10, the HPU 78 also actuates the packers 70, 72 and the return valve 64. Beneficially, this permits the apparatus 10 to be operated without the requirement to run in a mechanical setting tool, permitting the apparatus 10 to be run in a single trip into the borehole B.

Figure 8:
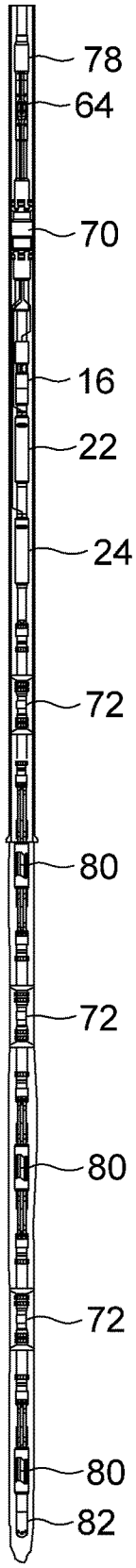
FIG. 8 shows part of a completion system including the completion system shown in FIGS. 1 to 3.
Figure 9:
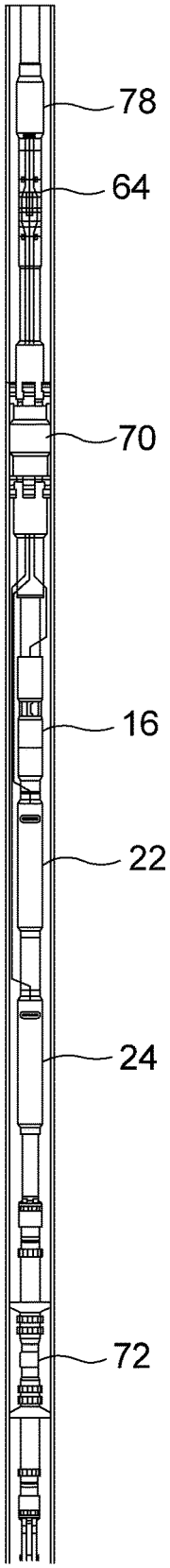
FIG. 9 shows an enlarged view of a first, upper part of the completion system shown in FIG. 8.
Figure 10:
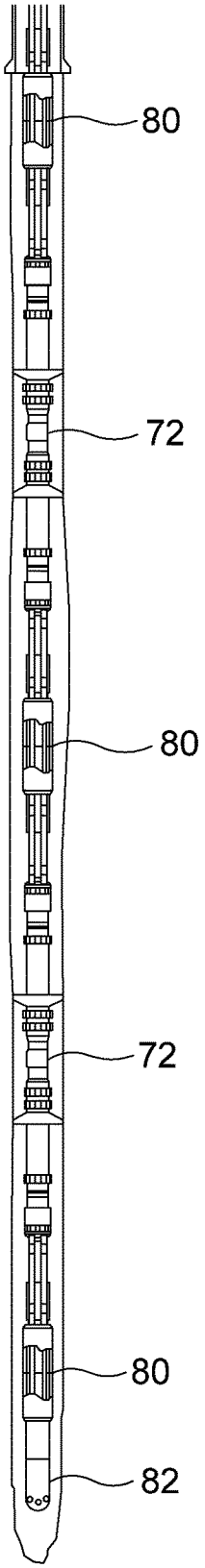
FIG. 10 shows an enlarged view of a second, lower, part of the completion system shown in FIG. 8.

As described above, the apparatus 10 may be provided in combination with, form part of, and/or may be coupled to, a completion system and FIGS. 8, 9 and 10 of the accompanying drawings show a completion system 1000 comprising the apparatus 10.

As shown in FIGS. 9, 10 and 11, the completion system 1000 further comprises a screen 80—in the illustrated system 1000 a shunted screen—and a pump down shoe 82.

It will be recognised that the apparatus 10 and completion system 1000 described above are merely exemplary and that various modifications may be made.

The invention claimed is:

1. A completion system apparatus, comprising:

a body configured for location in a borehole, the body comprising an axial flow passage therethrough and a lateral flow passage for providing access through a wall of the body; and a valve arrangement including a first valve assembly comprising a first valve member and a second valve member, the second valve member coupled to and/or forming part of the first valve member, the second valve member taking the form of a flapper, wherein the valve arrangement is configurable between a first, open, configuration in which passage of fluid through the axial flow passage is permitted and a second, activated, configuration, wherein, when the valve arrangement is in the first configuration, a throughbore of the first valve member is aligned or substantially aligned with the axial flow passage of the body, and wherein, when the valve arrangement is in the second configuration, the throughbore of the first valve member is misaligned with the axial flow passage of the body, the valve arrangement in the second, activated, configuration preventing passage of fluid through the axial flow passage in a first, downhole, direction so as to direct the fluid through the lateral flow passage while permitting the passage of fluid through the apparatus in a second, uphole, direction so as to permit return passage of the fluid through the apparatus.

2. The apparatus of claim 1, wherein the first valve assembly comprises a valve actuator arrangement.

3. The apparatus of claim 1, wherein the valve actuator arrangement is operable to move or rotate, the first valve member of the first valve assembly to reconfigure the valve arrangement from the first configuration to the second configuration.

4. The apparatus of claim 1, wherein the valve arrangement further comprises a second valve assembly.

5. The apparatus of claim 4, wherein the second valve assembly comprises a third valve member.

6. The apparatus of claim 5, wherein:

the second valve assembly is configured such that a throughbore of the valve member of the second valve assembly is aligned or substantially aligned with the axial flow passage of the body when the valve arrangement defines the first configuration; and the second valve assembly is configured such that the throughbore of the valve member of the second valve assembly and the axial flow passage of the body are misaligned when the valve arrangement defines the second configuration.

7. The apparatus of claim 4, wherein the second valve assembly comprises a valve actuator arrangement.

8. The apparatus of claim 7, wherein the valve actuator arrangement of the second valve assembly is operable to move or rotate, the third valve member of the second valve assembly to reconfigure the valve arrangement from the first configuration to the second configuration.

9. The apparatus of claim 4, wherein the second valve assembly comprises a fourth valve member.

10. The apparatus of claim 9, wherein the fourth valve member comprises or takes the form of another flapper.

11. The apparatus of claim 1, comprising a bypass arrangement configured to permit fluid travelling in the second direction to bypass the first valve assembly.

12. The apparatus of claim 11, wherein the bypass arrangement comprises at least one of:

a bypass conduit; and a bypass valve configurable between a first, closed, configuration, in which lateral passage of fluid is prevented or restricted and a second, open, configuration, in which lateral passage of fluid is permitted.

13. A completion system comprising the apparatus of claim 1.

14. The completion system of claim 13, comprising one or more screens.

15. A method comprising:

activating a valve arrangement of an apparatus according to claim 1 from the first, open, configuration in which passage of fluid through the axial flow passage of the body of the apparatus is permitted to the second, activated, configuration, the valve arrangement in the second, activated, configuration preventing passage of fluid through the axial flow passage in the first direction so as to direct the fluid through the lateral flow passage of the body of the apparatus while permitting the passage of fluid through the apparatus in the second direction so as to permit return passage of the fluid through the apparatus.

16. The method of claim 15, comprising at least one of:

running a completion system comprising the apparatus of claim 1 into a borehole; and directing a fluid through the apparatus.

* * * * *